United States Patent [19]

Clements

[11] Patent Number: 4,961,749

[45] Date of Patent: Oct. 9, 1990

[54] PROCESS FOR REMOVING PERMANGANATE STAINS FROM ARTICLES

[75] Inventor: James L. Clements, Henderson, Ky.

[73] Assignee: P.B. & S. Chemical Company, Inc., Henderson, Ky.

[21] Appl. No.: 387,899

[22] Filed: Aug. 1, 1989

[51] Int. Cl.[5] ..... D06L 3/06

[52] U.S. Cl. ..... 8/109; 8/101; 8/111

[58] Field of Search ..... 8/108, 111, 101, 109

[56] References Cited

U.S. PATENT DOCUMENTS

| | | | |
|---|---|---|---|
| 1,768,819 | 7/1930 | Bradley et al. | 8/111 |
| 2,052,320 | 8/1936 | Sjostrom | 127/71 |
| 2,172,233 | 9/1939 | Wilson | 149/5 |
| 3,384,444 | 5/1968 | Simpson et al. | 8/111 |
| 3,589,922 | 6/1971 | Asdell et al. | 106/288 B |
| 3,732,171 | 5/1973 | Kuhajek et al. | 252/105 |
| 4,795,476 | 1/1989 | Bean et al. | 8/107 |

*Primary Examiner*—Paul Lieberman
*Assistant Examiner*—John F. McNally
*Attorney, Agent, or Firm*—Donald L. Cox; David J. Roper

[57] ABSTRACT

A process for bleaching articles, such as fabrics, comprising the steps of treating an article with a permanganate bleaching agent and then reducing the permanganate with a reducing composition comprised of ammonium bisulfite and ammonium sulfite.

10 Claims, No Drawings

PROCESS FOR REMOVING PERMANGANATE STAINS FROM ARTICLES

BACKGROUND OF THE INVENTION

1. Field of Invention

This invention relates to bleaching. More particularly, this invention relates to bleaching articles, such as fabrics and garments, employing a permanganate and a reducing composition comprised of ammonium bisulfite and ammonium sulfite.

2. Prior Art

In the past few years, the wearing of "stone washed" materials has become popular. Stone washing new clothes, such as denim jeans, imparts a soft, worn look to them. Usually, pumice stones having diameters of about one-half to about four inches are used in a washing machine to circulate with the garments during the wash cycle thereby causing the garments to abrade and to soften. Although some prior art processees of stone washing are designed to prepare garments and fabrics having a uniform faded color, other prior art processees are designed to produce garments having streaks and non-uniform colors.

One method of preparing fabrics with non-uniform colors is to saturate pumice stones with a bleaching agent, wash the garments in the presence of the pumice stones, and then reduce the bleaching agent. This process is disclosed in U.S. Pat. No. 4,795,476. The patent discloses that garments are first treated with a permanganate bleaching agent and then the permanganate is reduced with a reducing mixture comprising a metabisulfite and a sulfite. The patent claims that the use of sodium sulfite with sodium metabisulfite reduces the odor of sulfur dioxide during washing at temperatures between 100° to 140° F. The patent, however, does not disclose that ammonium bisulfite can be used as the main reducing agent or that a reducing composition comprising ammonium bisulfite and ammonium sulfite simplifies the process while reducing sulfur dioxide odor.

U.S. Pat. No. 3,732,171 discloses a composition for removing iron ions from iron stained substances. The composition comprises a combination of an alkali metal hydrosulfite, such as sodium hydrosulfite, and an alkali metal sulfite contributor, such as sodium sulfite and ammonium sulfite. The patent discloses that the evolution of sulfur dioxide is significantly reduced when sodium sulfite or ammonium sulfite is used in conjunction with sodium hydrosulfite. However, the patent does not disclose that when ammonium sulfite is used in conjunction with ammonium bisulfite, the evolution of sulfur dioxide odor is significantly reduced.

U.S. Pat. Nos. 2,052,320, 2,172,233, 3,384,444 and 3,589,922 and British Patent No. 586,020 disclose the use of potassium permanganate as a bleaching agent and the reduction of the permanganate with a sulfite. However, these patents do not disclose the reduction of the permanganate with a reducing composition comprising ammonium bisulfite and ammonium sulfite and do not suggest that such a reducing composition would reduce the odor of sulfur dioxide.

One of the problems with permanganate bleaching processees is that during the reduction of the permanganate with sulfites, there is usually a strong sulfur dioxide odor which is undesirable. Another problem in the prior art processes is that expensive sulfite reducing agents, such as sodium metabisulfite and sodium sulfite, are employed. A further problem is that most of the sulfite reducing agents have a limited solubility in water thereby adding to the cost of reducing permanganates.

Accordingly, it is an object of the invention to reduce the generation of sulfur dioxide in a permanganate bleaching process.

It is a further object of this invention to decrease the costs of reducing permanganate bleaching agents in a permanganate bleaching process.

These and other objects are obtained by the process of the present invention.

SUMMARY OF THE INVENTION

The instant invention constitutes a bleaching process comprising the steps of:

(a) treating an article to be bleached with a permanganate bleaching agent; and (b) reducing the permanganate with a reducing composition containing a weight percent ratio of sulfur dioxide to ammonia in the range of about 3.1:1 to about 3.65:1 so that during the bleaching process substantially no sulfur dioxide odor is detectable.

The process of the present invention can be employed to bleach a wide variety of articles, including wood pulp, fibers, fabrics, and garments.

DETAILED DESCRIPTION OF INVENTION

In the instant invention a wide variety of permanganate bleaching agents may be employed, such as alkali metal and alkaline-earth metal permanganates. Preferably, potassium permanganate and sodium permanganate are employed, and most preferably potassium permanganate is employed as the permanganate bleaching agent. The permanganate alone may be used or the permanganate compounded with other materials may be employed. For example, the permanganates can be compounded with calcium sulfate and diatomaceous earth. One such suitable compounded material is Denox 300 which is prepared by the Carus Chemical Co. These special permanganate compounds are readily available commercially. In addition, other oxidizing agents, such as sodium hypochlorite, may be employed with the permanganate bleaching agents.

The process of this invention can be used to bleach a wide variety of articles that have been treated with or stained by a permanganate bleaching agent. For example, the process can be used to reduce permanganate stained wood pulp, fibers, fabrics, and garments.

A wide variety of methods may be employed to treat an article with the permanganate bleaching agent. One method involves preparing a permanganate solution which is applied to an article or in which an article is placed. For example, the article can be submerged in a vat containing the permanganate solution. Generally, the permanganate will be dissolved in water. The amount of permanganate employed will depend upon the degree of bleaching and the nature of the material employed. Generally, a solution containing about 1 to about 8 percent by weight permanganate based upon the total weight of permanganate and water will be employed The permanganate bleaching process is generally conducted at a temperature of about 60° F. to about 110° F.

When fabrics or garments are to be bleached and a non-uniform color is desired, pumice stones or similar substances saturated with the permanganate bleaching agent may be used. Generally, a wide variety of hard, course materials having some porosity can be used, such as coral stone, chopped up brick or concrete, or diatomaceous earth. Such materials may be placed in conventional washers and agitated with the fabrics or garments. Although the time of agitation will depend upon the degree of bleaching desired, usually, the garments and fabrics are agitated for about 8 to about 35 minutes at a wash temperature of about 60° F. to about 110° F. The bleaching effect is dependent on the permanganate concentration and the characteristics of the stone or similar substance used to treat the fabric. When garments and fabrics are treated, any suitable agitation means may be employed, such as a conventional washer.

After the article is treated with the permanganate bleaching agent, the article will have brown stains from the permanganate. In order to remove these brown stains, it is necessary to reduce the permanganate stain. According to the instant invention the permanganate stain can be reduced by a reducing composition comprising ammonium bisulfite and ammonium sulfite in water. Although the reducing composition will be comprised primarily of ammonium bisulfite, ammonium bisulfite is not employed alone since an undesirable level of sulfur dioxide odor is present when temperatures above 50° F. are employed. In order to permit the reducing process to take place at temperatures above 50° F. without the presence of a strong sulfur dioxide odor, it is necessary to employ ammonium sulfite in conjunction with ammonium bisulfite. Preferably, the reduction of permanganate takes place at a temperature in the range of about 60° F. to about 180° F., most preferably in the range of about 100° F. to about 150° F.

The pH of the reducing composition needed to substantially reduce the sulfur dioxide odor depends upon the temperature at which the reduction step takes place. Generally at lower temperatures, lower pHs may be employed. Usually, the reducing composition should have a pH of about 4.5 to about 6.5, preferably about 5.0 to about 6.0 and most preferably about 5.5 to about 5.6. If the pH exceeds about 6.5, the reducing composition does not function well and it takes longer periods of time to reduce a permanganate stain. If the pH falls below 4.5 an odor problem with sulfur dioxide will develop.

In order to prepare a reducing composition which contains the appropriate amount of ammonium bisulfite and ammonium sulfite so as to substantially eliminate the odor of sulfur dioxide at the temperature at which the reduction of permanganate stains takes place, sulfur dioxide and ammonia are mixed with water at a certain weight percent ratio. Preferably, the weight percent ratio of sulfur dioxide to ammonia will be in the range of about 3.1:1 to about 3.65:1, preferably about 3.3:1 to about 3.5:1, and most preferably about 3.5:1. If the ratio of 3.65:1 of sulfur dioxide to ammonia is exceeded, then there will be an odor problem with sulfur dioxide.

The reducing composition is prepared by adding sulfur dioxide and ammonia, preferably anhydrous ammonia, in the appropriate ratio to water until a pH in the range described above is achieved. The resulting solution will contain both ammonium bisulfite and ammonium sulfite. The amount of ammonium bisulfite and ammonium sulfite in the reducing composition can be adjusted by changing the pH or the ratio of sulfur dioxide to ammonia. The actual percent by weight of ammonia and sulfur dioxide in the reducing composition is not critical. Rather, the weight percent ratio of sulfur dioxide to ammonia is what is critical. Consequently, it does not matter how dilute or concentrated the ammonia and sulfur dioxide are in the reducing composition. For example, the percent by weight of sulfur dioxide could be low, such as 0.3%, or high, such as about 48%, in the reducing composition.

The permanganate stained article is exposed to the reducing composition for a period of time sufficient to remove the stains. Preferably, the article will be submerged and agitated in the reducing composition. The time of exposure will depend upon the degree of agitation, the amount of permanganate present on the article, the concentration of the sulfites in the reducing composition, and the temperature. Generally, if the article is exposed for about 8 to about 35 minutes, the stains will be removed. The permanganate stain may be reduced in one or more exposures to the reducing composition. For example, permanganate stained garments can be treated to two or more washing cycles in a normal washing machine which has added thereto the reducing composition.

After the permanganate has been reduced, the article is usually rinsed or washed with water one or more times to remove the residual reducing composition and then dried by any conventional means.

The invention is illustrated by the following examples in which all percentages are by weight unless otherwise indicated.

EXAMPLE

Twenty-two pounds of jeans were placed in a washer and desized using an enzyme stripper. The jeans were then rinsed several times, dried, and then placed in a washer with potassium permanganate soaked pumice stones and tumbled for about fifteen minutes. Next, the jeans were separated from the stones and placed in a conventional washer where they were rinsed with water several times to get rid of all the loose permanganate on the jeans.

Three pounds of a reducing solution having a pH of about 5.5 and a sulfur dioxide to ammonia weight percent ratio of 3.51:1 was then added to the washer. The jeans were washed for fifteen minutes followed by three, two-minute rinses and a 40 minute drying period. Upon inspection, the permanganate stains were removed and the jeans had a stone-washed appearance.

By this process, fabrics of high quality, stone-washed appearance can be created. No perceptible sulfur dioxide gas was present during the process. This process, therefore, discloses a low cost means of reducing permanganate stains while maintaining a low sulfur dioxide odor.

What is claimed is:

1. A bleaching process comprising the steps of:
(a) treating a fiber, a fabric or garment with a permanganate bleaching agent; and
(b) reducing the permanganate with a reducing composition containing sulfur dioxide and ammonia at a weight percent ratio in the range of about 3.1:1 to about 3.65:1.

2. A bleaching process comprising the steps of:
(a) treating a fiber, fabric or garment with potassium permanganate; and
(b) reducing the permanganate with a reducing composition containing sulfur dioxide and ammonia at a weight percent ratio in the range of about 3.1:1 to about 3.65:1.

3. The process of claim 1 or 2 wherein the reducing composition has a pH in the range of about 4.5 to about 6.5.

4. The process of claim 1 or 2 wherein the reducing composition has a pH in the range of about 5.0 to about 6.0.

5. The process of claim 1 or 2 wherein the reducing composition has a pH in the range of about 5.5 to about 5.6.

6. The process of claim 1 or 2 wherein the sulfur dioxide and ammonia are present at a ratio in the range of about 3.3:1 to about 3.5:1.

7. The process of claim 1 or 2 wherein the sulfur dioxide and ammonia are present at a ratio of about 3.5:1.

8. The process of claim 1 or 2 wherein the reduction of permanganate is carried out at a temperature in the range of about 60° F. to about 180° F.

9. The process of claim 1 or 2 wherein the reduction of permanganate is carried out at a temperature in the range of about 100° F. to about 150° F.

10. The process of claim 1 wherein the permanganate bleaching agent is selected from the group consisting of potassium permanganate and sodium permanganate.

* * * * *